US005603559A

United States Patent [19]

Yemini

[11] Patent Number: 5,603,559

[45] Date of Patent: Feb. 18, 1997

[54] STORAGE ORGANIZER

[75] Inventor: Zvi Yemini, Tel Aviv, Israel

[73] Assignee: ZAG Ltd., Tel Aviv, Israel

[21] Appl. No.: 514,370

[22] Filed: Aug. 11, 1995

[51] Int. Cl.[6] ..... A47B 88/20; A47B 95/02

[52] U.S. Cl. ..... 312/333; 312/334.44; 312/344.27; 312/183; 312/244; 312/348.3; 220/4.27; 220/533; 292/DIG. 38; 292/175

[58] Field of Search ..... 312/333, 330.1, 312/183, 187, 188, 190, 244, 270.1, 270.3, 272.5, 293.1, 348.3, 334.44, 334.27, 107, 108, 111; 220/4.27, 533; 292/DIG. 38, DIG. 30, 175

[56] References Cited

U.S. PATENT DOCUMENTS

| | | | |
|---|---|---|---|
| 1,223,455 | 4/1917 | Weiss | 292/175 |
| 2,123,803 | 7/1938 | Regenhardt | 312/334.44 X |
| 2,704,699 | 3/1955 | Evans | 312/344.44 X |
| 3,272,581 | 9/1966 | Stucki | 312/344.44 X |
| 3,316,045 | 4/1967 | Leland | 312/333 X |
| 3,796,474 | 3/1974 | Noneman et al. | 312/334.44 X |
| 4,155,611 | 5/1979 | Brekke et al. | 312/334.44 |
| 4,505,526 | 3/1985 | Leck | 312/334.44 X |
| 4,577,773 | 3/1986 | Bitel | 220/533 |
| 4,848,588 | 7/1989 | Rasmussen | 220/533 X |
| 5,205,595 | 4/1993 | Svehaug | 292/DIG. 38 |
| 5,246,105 | 9/1993 | Eykmann et al. | 220/4.27 X |
| 5,299,688 | 4/1944 | McKay et al. | 220/533 X |
| 5,344,226 | 9/1994 | Lee | 312/333 X |
| 5,358,321 | 10/1994 | Leonardi | 312/330.1 X |
| 5,426,885 | 6/1995 | Wittman | 312/244 X |

*Primary Examiner*—Peter M. Cuomo
*Assistant Examiner*—Rodney B. White

[57] ABSTRACT

A storage organizer, which includes a housing and drawers which are slidably accommodated within the housing. The drawers feature a locking mechanism connected to said front wall for immobilizing said drawer in said housing. The drawers further feature a downwardly extending protrusion which serves to slidably engage the housing and thereby reduce play between the drawer and the housing. The drawers further feature removable vertical dividers.

11 Claims, 4 Drawing Sheets

FIG. 2
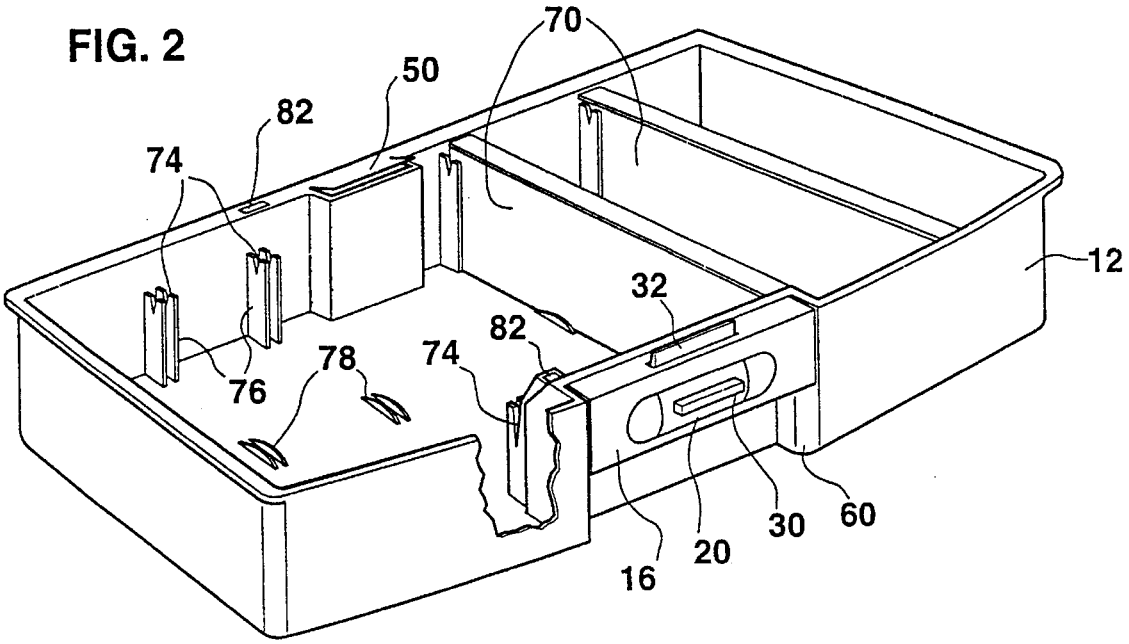
FIG. 3
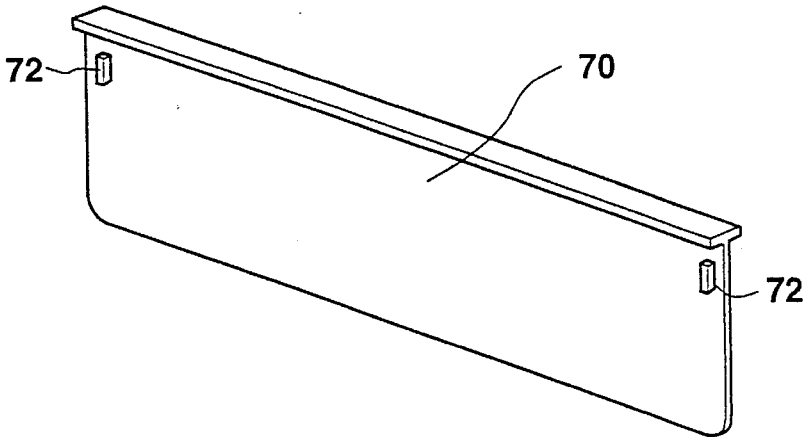
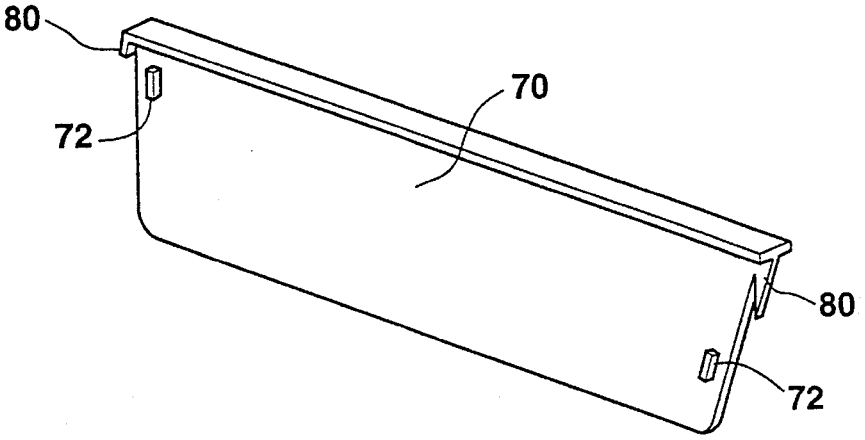
FIG. 4

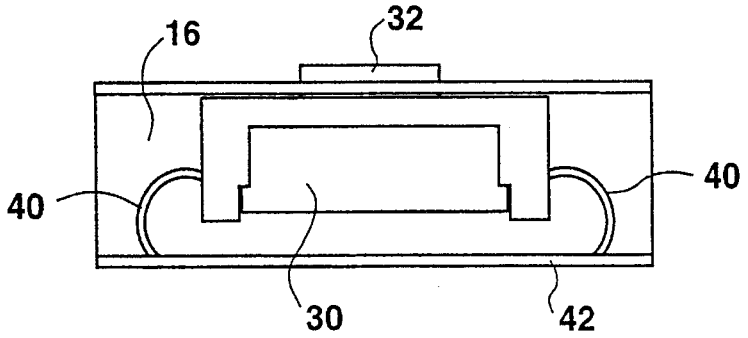
FIG. 8
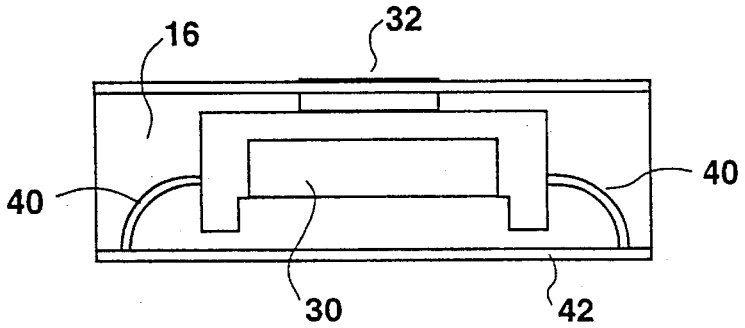
FIG. 9
FIG. 10
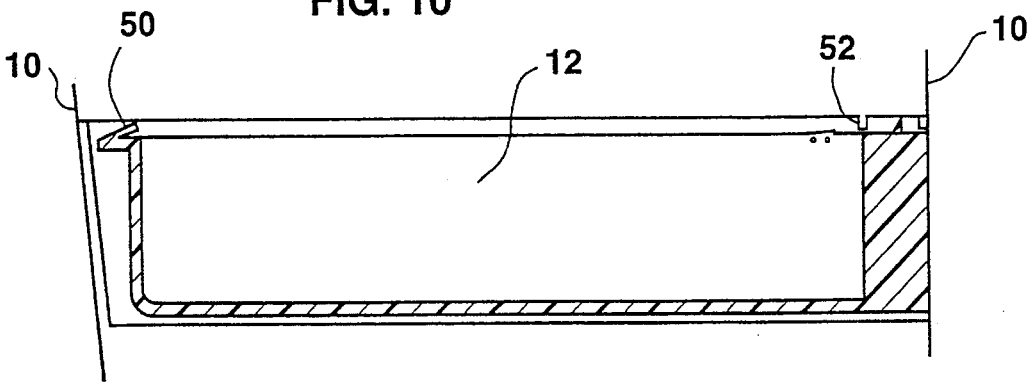
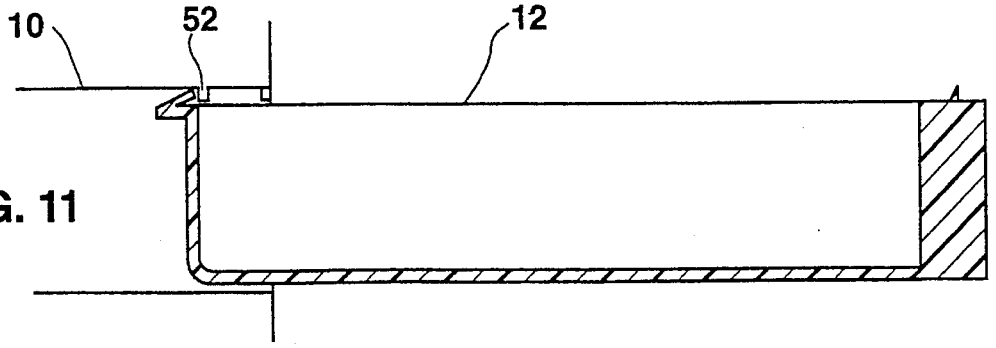
FIG. 11

STORAGE ORGANIZER

FIELD AND BACKGROUND OF THE INVENTION

The present invention relates to devices for storing in an organized fashion a large number of relatively small items of different types and which make it possible to easily store and retrieve items.

In a wide variety of applications it is highly desirable to store small items in an organized manner so as to facilitate the retrieval of individual items when needed. For example, a carpenter makes use of screws and nails of various types. Often, during the course of a single job, use may arise for several types of screws or nails. Storing all the screws and nails in a single container may save space but wasters considerable on-the-job time when the worker has to rummage through the container in search of just the right nail. Furthermore, since it is virtually impossible to see the entire contents of the container, it may often happen that the inventory of a particular type of screw is exhausted without the worker realizing it, which could again lead to a waste of time while the inventory is replenished or which could lead to the use of an inappropriate screw.

Various storage organizers have been devised to offer a solution to this problem, which faces not only carpenters but also fishermen who use a variety of lures, dentists who use a variety of drills and other small instruments, office clerks who are responsible for stocking writing implements and other office supplies, and many others.

One solution involves the use of a storage organizer. The storage organizer typically includes a frame, or housing, into which are inserted a number of drawers. Each drawer is formed into a number of compartments, each of which can store one or more samples of a particularly item. Typically, the front surface of each compartment is transparent so that the user can see the items without having to open the drawer. Alternatively or additionally, the front surface of each compartment may be marked in any suitable way to provide an indication of its contents. A storage organizer typically includes a handle connected to its top surface which makes it possible to carry the organizer from place to place.

Conventional storage organizers suffer from a number of disadvantages. First, when the organizer is carried from place to place is it common for one or more of the drawers to inadvertently slide open, which may lead to the spilling and loss of items from the drawers.

Second, when a user opens a drawer care must be exercised to pull the drawer only part way so as to avoid retracting the drawer completely from the housing, which could lead to spillage of the contents.

Third, there is a tendency for the drawers to loosely fit into their intended space in the housing. This could lead to the loss of small items throught the boundaries between the drawer and housing and could also lead to unnecessary shaking and noise during transport.

Fourth, the integrally formed dividers which define the compartments are integrally formed with the drawer so that the dimensions of the compartments are permanently defined and cannot be altered to fit specific needs.

There is thus a widely recognized need for, and it would be highly advantageous to have, a storage organizer which has snugly fitted drawers which can be immobilized so as to avoid inadvertent opening, which includes a mechanism for avoiding the inadvertently pulling of the drawer completely from the housing, and which has removable dividers defining the compartments in the drawers.

SUMMARY OF THE INVENTION

According to the present invention there is provided a storage organizer, comprising: (a) a housing; and (b) at least one drawer slidably accommodated within the housing, the drawer having a floor, a back wall and a front wall, the drawer featuring a locking mechanism connected to the from wall for immobilizing the drawer in the housing.

According to further features in preferred embodiments of the invention described below, the locking mechanism includes an outwardly biased locking bolt, using an integral spring, for engaging the housing when the drawer is fully inserted within the housing.

Also according to the present invention, there is provided a storage organizer, comprising: (a) a housing; and (b) at least one drawer slidably accommodated within the housing, the drawer having a floor, a front wall and a back wall, the drawer featuring a downwardly extending element connected to the floor, the element serving to slidably engage the housing and thereby reduce play between the drawer and the housing.

Further according to the present invention, there is provided a storage organizer, comprising: (a) a housing; and (b) at least one drawer slidably accommodated within the housing, the drawer having a floor, a front wall and a back wall, the drawer featuring at least one removable substantially vertical divider.

The present invention successfully addresses the shortcomings of the presently known configurations by providing a storage organizers having drawers which can be immobilized, which can be pulled out with safety without danger of spillage, which have reduced play and which include removable dividers.

BRIEF DESCRIPTION OF THE DRAWINGS

The invention is herein described, by way of example only, with reference to the accompanying drawings, wherein:

FIG. 2 is a perspective and partial cutaway view of a single drawer of the storage organizer of FIG. 1;

FIG. 3 is a perspective view of one of the dividers of FIG. 2;

FIG. 4 is a perspective view of another of the dividers of FIG. 2;

FIG. 8 is a back view of a locking mechanism according to the present invention when in the locked position;

FIG. 9 is a back view of a locking mechanism according to the present invention when in the unlocked position;

FIG. 10 is a side cross-sectional view of a drawer according to the present invention when the drawer is fully inserted into the housing;

FIG. 11 is a side cross-sectional view of the drawer of FIG. 10 when the drawer has been retracted from the housing to the maximum extent without fully separating the drawer from the housing.

DESCRIPTION OF THE PREFERRED EMBODIMENTS

The present invention is of a storage organizer which can be used to stored in an organized manner a number of relatively small items, such as nails, screws, connectors, writing instruments, artificial bait, and the like.

The principles and operation of a storage organizer according to the present invention may be better understood with reference to the drawings and the accompanying description.

Figure 1:
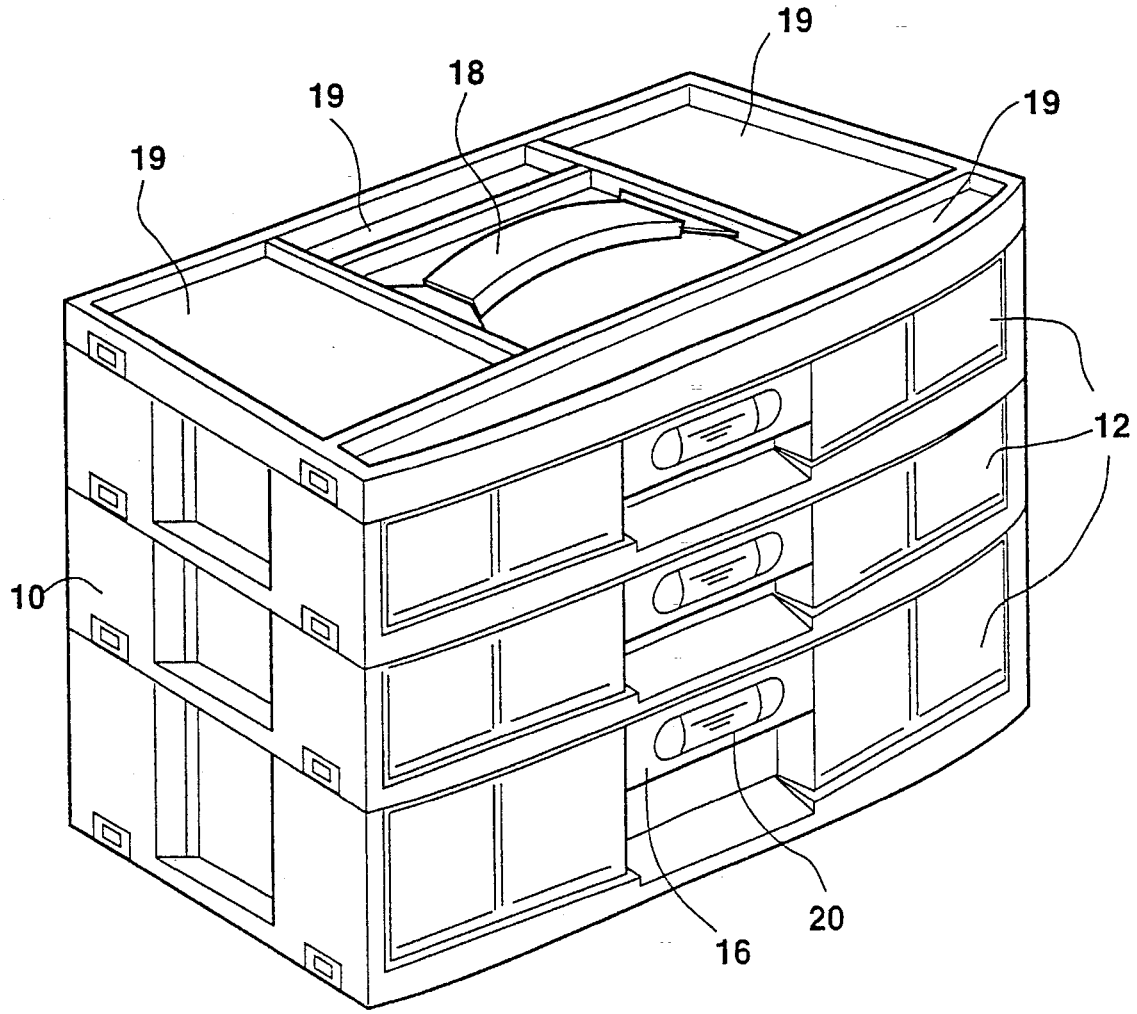
FIG. 1 is a perspective view of one embodiment of a storage organizer according to the present invention.
Figure 5:
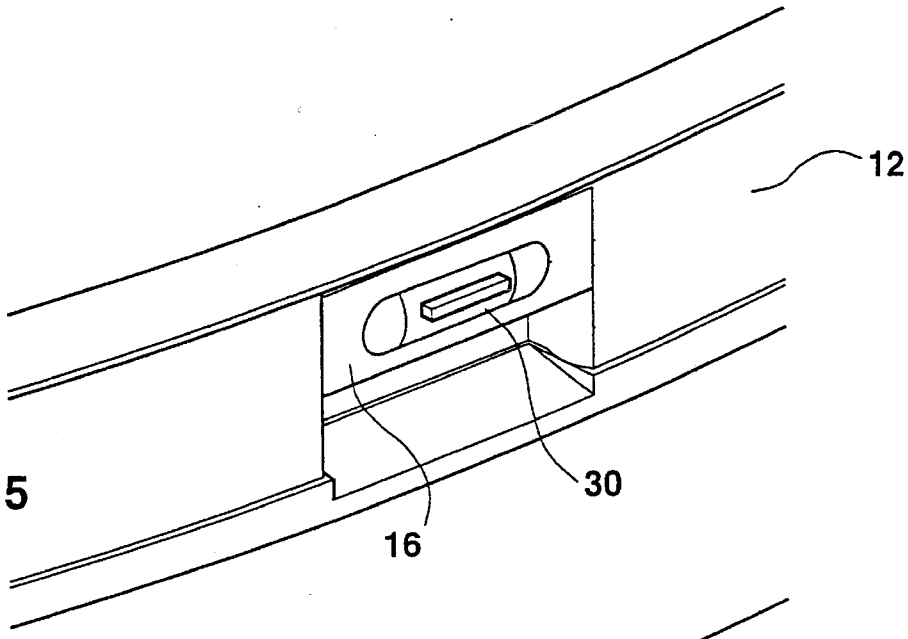
FIG. 5 is a perspective view of the locking handle portion of the drawer of FIG. 2.
Figure 6:
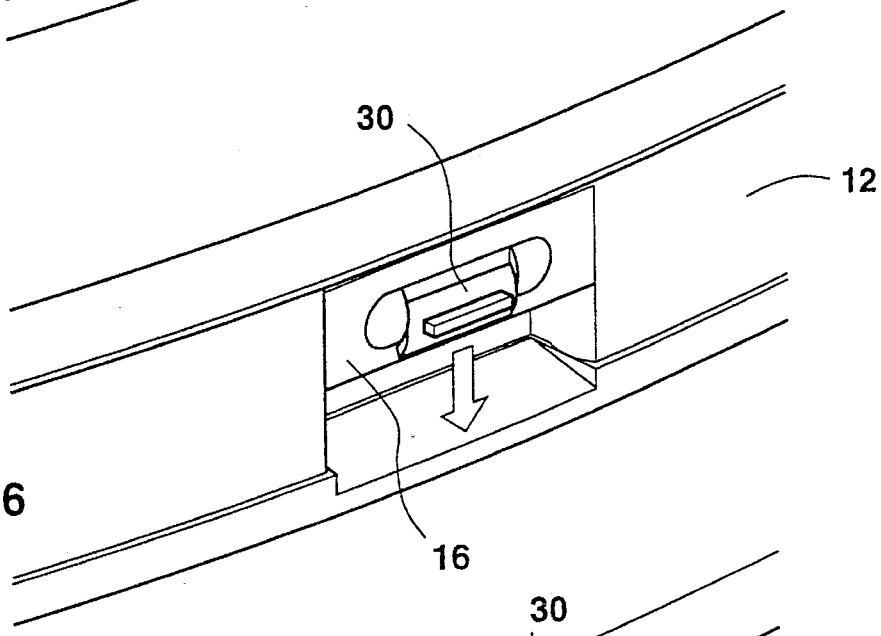
FIG. 6 is a view as in FIG. 5 but with the locking member displaced downward.

Referring now to the drawings, FIG. 1 illustrates an example of a storage organizer according to the present invention. The embodiment shown in FIG. 1 includes three vertically arrayed drawers with the top two drawers being relatively shallow and the lowest drawer being relatively deep. It will be appreciated that various configurations, having various number of drawers of various depths may be assembled.

A storage organizer according to the present invention includes a housing 10 and one or more drawers 12 which are slidably accommodated within housing 10, preferably vertically arrayed relative to each other. Preferably, the front wall of drawer 12 features a centrally located handle 16 (see also FIG. 2) for facilitating the sliding of drawer 12 into, and, especially, away from, housing 10. Preferably, the top surface of housing 10 includes a carrying handle 18 to facilitate transportation of the organizer from place to place. Preferably, as can be seen in FIG. 1, the top surface of housing 10 includes a number of tray-like regions 19 which can serve the user for temporary placement of small parts during operations.

In one embodiment according to the represent invention, in order to immobilize drawer 12 within housing 10 so as to prevent drawer 12 from inadvertently sliding somewhat away from housing 10, drawer 12 features a locking mechanism 20 which is preferably connected to the front wall of drawer 12. Most preferably, locking mechanism 20 is associated with handle 20.

Shown in FIGS. 2 and 5–9 is one possible configuration of locking mechanism 20. As may be seen in FIG. 2, handle 16 features a slidable knob 30 which is upwardly biased and whose workings are described below. Knob 30 is connected to a bolt member 32 which extends upwardly beyond the top plane of drawer 12. When drawer 12 is fully inserted within housing 10 (FIG. 5), knob 30 is in its normal uppermost position so that bolt member 32 is upwardly extended so as to engage housing 10 and thereby immobilize drawer 12 relative to housing 10.

When it is desired to partly open drawer 12, the user depresses knob 30 downward (FIG. 6) using, for example, the thumb, and then, while knob 30 is still depressed, the user pulls handle 16 in a direction away from housing 10. The outward sliding of drawer 12 is made possible by the withdrawal, upon the depression of knob 30, of bolt member 32 from housing 10. Once drawer 12 has been slightly pulled away from housing 10, knob 30 may be released, allowing it to move upward to its normal upwardly biased position (FIG. 7).

One possible configuration of locking mechanism 20 is shown in FIG. 8 and 9 which show the back sides of handle 16. The connection between knob 30 and bolt member 32 is clear in these Figures. Also shown in FIGS. 8 and 9 is one possible mechanism for upwardly biasing knob 30 and bolt member 32. Here, use is made of an integral spring in the form of a pair extended flexible arms 40. Each arm 40, which is preferably made, as is the rest of the device, of a suitable plastic, is connected to, or integrally formed with, (herein referred to singly together as 'connected to') knob 30, and hence to bolt member 32. The free end of each arm 40 is slidable over a ledge 42 of handle 16, so as to allow bolt member 32 to move. FIG. 8 shows the normal position with bolt member 32 being fully extended outwardly under the upward biasing force of arms 40. FIG. 9 shows the situation when knob 30 is being downwardly depressed to the maximum extent against the upward biasing force of arms 40 to cause bolt member 32 to full withdraw from housing (not shown) so as to enable the sliding of drawer 12 into or out of the locked position when drawer 12 is fully inserted within housing 10.

As shown in FIGS. 2, 10 and 11, the back wall of drawer 12 preferably includes a protrusion 50 designed to engage housing 10 when drawer 12 is partially retracted from housing 10 to a pre-selected extent. Most typically, it is desired to allow drawer 12 to retract only to a position such that drawer 12 remains substantially horizontal and so that most of its contents are readily exposed and accessible (e.g., as shown in FIG. 11). Further retraction of drawer 12 could lead to drawer 12 separating from housing 10 and could lead to spillage of the contents. Protrusion 50 engages a complementary limiting element 52 of housing 10 so that once protrusion 50 is engaged no further retraction of drawer 12 can take place in the absence of significantly increased force and/or twisting or another action.

Figure 7:
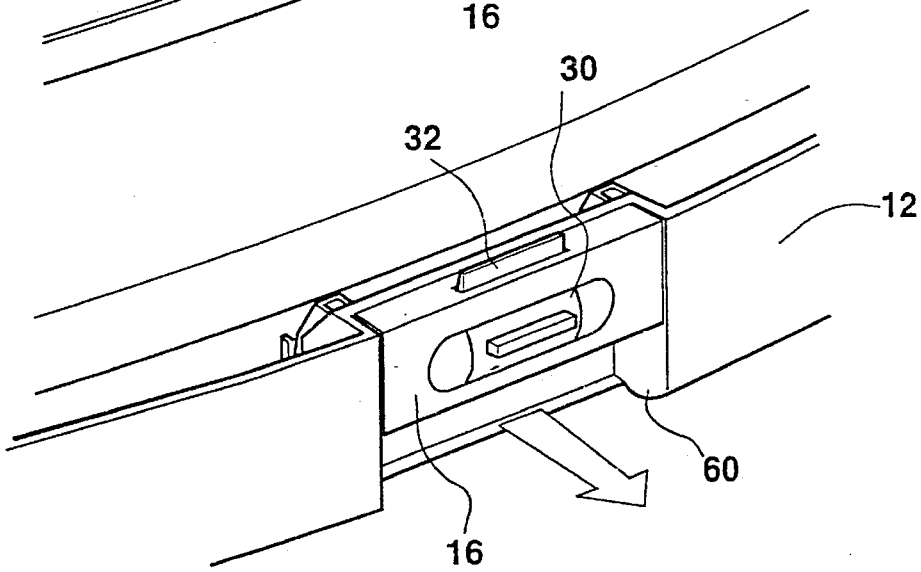
FIG. 7 is a view as in FIG. 5 but after the drawer has been slightly displaced out the housing.

Preferably, drawer 12 includes a downwardly extending element 60 connected to, or integrally formed with (herein referred to singly together as 'connected to'), the floor of drawer 12 (FIGS. 2 and 7). Preferably several such downwardly extending elements 60 are used. Downwardly extending elements 60 serve to slidably engage housing 10 and thereby reduce the amount of slack or play between drawer 12 and housing 10.

Preferably, as shown in FIGS. 2–4, a storage organizer according to the present invention includes one or more removable dividers 70 arranged substantially vertically with drawer 12. Dividers 70 serve to mechanically support the structure of drawer 12 and further serve to divide the inner space of each drawer 12 into a number of compartments. The use of removable dividers 70 makes it possible for the user to custom make, to some extent, the compartments within each drawer 12 to fit his specific needs.

Two configurations of dividers 70 according to the present invention are shown in FIGS. 2–4. In one configuration, shown in FIG. 3, divider 70 includes two pairs of substantially vertically extending protrusions 72 near the upper corners of divider 70. Vertically extending protrusions 72 are designed to fit into substantially vertical slits 74 near the top portions of substantially vertical channels 76 formed in the front and back walls of drawer 12.

Preferably, the floor of drawer 12 also includes horizontal guides or channels 78 for accommodating divider 70 and for further serving to fix its location within drawer 12.

Another embodiment of divider 70 is shown in FIG. 4 (and FIG. 2). Here, divider 70 includes overhanging lips 80 at the upper corners of divider 70. The front wall and back wall of drawer 12 include openings 82 which accommodate overhanging lips 80 of divider 70 so as to aid in fixing the location of divider 70.

While the invention has been described with respect to a limited number of embodiments, it will be appreciated that many variations, modifications and other applications of the invention may be made.

What is claimed is:

1. A storage organizer, comprising:

(a) a housing; and (b) at least one drawer slidably accommodated within said housing, said drawer having a floor, a back wall and a front wall, said drawer featuring a locking mechanism connected to said front wall for immobilizing said drawer in said housing, said locking mechanism including an outwardly biased locking bolt for engaging said housing when said drawer is fully inserted within said housing, said locking bolt including at least one integral biasing spring in the form of a pair of extended flexible arms having a free end and an end which is connected to said bolt, said free end being slidable along a ledge, said ledge forming a part of said front wall, so as to allow said bolt to move.

2. The storage organizer of claim 1, wherein flexible arms are constructed of plastic.

3. The storage organizer of claim 1, wherein said back wall of said drawer includes a protrusion for engaging said housing when said drawer is partially retracted from said housing to a pre-selected extent.

4. The storage organizer of claim 1, wherein said drawer features a downwardly extending element connected to said floor, said element serving to slidably engage said housing and thereby reduce play between said drawer and said housing.

5. The storage organizer of claim 1, wherein said drawer features at least one removable substantially vertical divider.

6. A storage organizer comprising:

(a) a housing; and (b) at least one drawer slidably accommodated within said housing, said drawer having a floor, a front wall and a back wall, said drawer featuring at least one removable substantially vertical divider, said front wall and said back wall of said drawer including substantially vertical channels for slidably accommodating said at least one divider, said at least one divider including a pair of protrusions extending in a perpendicular manner to said vertical channels near upper corners of said divider and wherein said substantially vertical channels each includes substantially vertical slits for accommodating said perpendicular extending protrusions of said divider.

7. The storage organizer of claim 6, wherein said floor of said drawer include a channel for accommodating said at least one divider.

8. The storage organizer of claim 6, wherein said divider includes overhanging lips at upper corners of said dividers and wherein said front wall and said back wall of said drawer include laterally enclosed openings for accommodating said overhanging lips of said divider.

9. The storage organizer of claim 6, wherein said back wall of said drawer includes a protrusion for engaging said housing when said drawer is partially retracted from said housing to a pre-selected extent.

10. The storage organizer of claim 6, wherein said drawer features a locking mechanism connected to said front wall for immobilizing said drawer in said housing.

11. The storage organizer of claim 6, wherein said drawer features a downwardly extending element connected to said floor, said element serving to slidably engage said housing and thereby reduce play between said drawer and said housing.

* * * * *